US006028029A

United States Patent [19]

Takeuchi

[11] Patent Number: 6,028,029

[45] Date of Patent: Feb. 22, 2000

[54] HEAT-SENSITIVE RECORDING MATERIAL

[75] Inventor: Koh Takeuchi, Shizuoka-ken, Japan

[73] Assignee: Fuji Photo Film Co., Ltd., Kanagawa, Japan

[21] Appl. No.: 09/360,628

[22] Filed: Jul. 26, 1999

[30] Foreign Application Priority Data

Jul. 31, 1998 [JP] Japan ..... 10-217759

[51] Int. Cl.[7] ..... B41M 5/40

[52] U.S. Cl. ..... 503/207; 427/152; 430/162; 503/226

[58] Field of Search ..... 427/150–152; 430/162; 503/200, 207, 215–218, 220, 221, 226

[56] References Cited

FOREIGN PATENT DOCUMENTS

| | | |
|---|---|---|
| 5-116449 | 5/1993 | Japan . |
| 7-76168 | 3/1995 | Japan . |
| 8-156410 | 6/1996 | Japan . |
| 8-290663 | 11/1996 | Japan . |
| 9-20077 | 1/1997 | Japan . |

*Primary Examiner*—Bruce H. Hess
*Attorney, Agent, or Firm*—Sughrue, Mion, Zinn, Macpeak & Seas, PLLC

[57] ABSTRACT

Disclosed in a heat-sensitive recording material comprising a substrate, a heat-sensitive recording layer disposed on the substrate and a protective layer disposed on the heat-sensitive recording layer, wherein the protective layer contains a pigment containing particles having an average particle diameter of 0.300 μm or less in a portion of 50% by volume in the total volume of the particles as measured by a laser diffraction method and containing 3% or less of particles having a diameter of 1.0 μm or more in a total amount of particles and the surface of the protective layer has a central line value Ra of a surface roughness of 0.3 μm or less in a frequency component having a roughness pitch of 2 to 10 μm of the surface roughness in the entire frequency range.

The heat-sensitive recording material does not cause sticking or generation of noise during recording, has an excellent transparency, reduces wear of a thermal head even in recording using a high thermal energy and provides high quality images with stability for a long time.

20 Claims, No Drawings

HEAT-SENSITIVE RECORDING MATERIAL

BACKGROUND OF THE INVENTION

1. Field of the Invention

The present invention relates to a heat-sensitive recording material, and more particularly, to a heat-sensitive recording material which has excellent transparency, does not cause sticking or generation of noise during recording, provides high quality images suitable for a recording medium used in the medical field and exhibits a broad dynamic range.

2. Description of the Related Art

Heat-sensitive recording has been widely used recently in various fields because the heat-sensitive recording has advantages such as: (1) developing processing is not necessary; (2) recording materials having a quality close to that of general use paper are obtained when paper is used as the substrate; (3) handling is easy; (4) a high developed color density of coloring can be obtained; (5) simple, reliable and inexpensive recording apparatuses can be used; (6) noise is not generated during recording; and (7) no particular maintenance is required. Heat-sensitive recording is increasingly used, for example, in the field of facsimiles and printers and in the field of labels such as POS.

As the heat-sensitive material used for the above heat-sensitive recording, heat-sensitive recording materials utilizing the reaction of colorless electron-donating dyes and electron-accepting compounds and heat-sensitive recording materials utilizing the reaction of diazo compounds and couplers have been widely known.

Under these circumstances, a transparent heat-sensitive recording material which can be recorded directly by a thermal head is desired recently so that multicolor images can be recorded and recorded images can be projected by an overhead projector or can be directly observed on a light table.

It is proposed that a heat-sensitive recording material be prepared by disposing, on a transparent substrate such as a film of a synthetic polymer substance, a heat-sensitive recording layer which is formed by dispersing a substantially colorless color forming component A and a substantially colorless color forming component B which develops color by reaction with the color forming component A in a binder as fine particles or by using either one of components A and B which are micro-encapsuled and the other component in the form of an emulsion.

Although the above heat-sensitive recording material has excellent transparency, the above heat-sensitive recording material has a drawback in that sticking occurs and noise is generated when the heat-sensitive recording material is used for forming images using a heat-sensitive recording apparatus such as a thermal recording printer. To overcome the drawback, it is proposed that a protective layer composed of a pigment and a binder as main components is disposed on the heat-sensitive recording layer of the heat-sensitive recording material.

However, when the above transparent heat-sensitive recording material is used as an image outputting medium in which a particularly high density of black color is required, the heat-sensitive recording material has a problem in that a thermal head becomes extremely worn. Therefore, circuits in the thermal head are broken or recorded images have defects such as missing portions and blurrings.

In particular, when the above transparent heat-sensitive recording material is used as a recording medium in the medical field, formation of defects such as uneven distribution of density and missing portions of images during printing of images must be prevented as much as possible because a particularly high density of black color is required in images used in the medical field and delicate differences in the density of images are detected as signals and used for diagnosis. In general, when a thermal head is used for recording, the thermal head is designed so as to have a large dynamic range, i.e., a large energy range required for obtaining the saturated transmission density $D_{T\text{-}max}$, to reduce fluctuations in the density caused by slight differences in the thermal conductivity between heating resistors in the head. Therefore, the energy is applied to the thermal head for a longer time during printing. Moreover, a high density of black color is required as described above. Thus, the thermal energy applied during printing is markedly higher than that in general use facsimiles and label printers and the thermal head is used under a very disadvantageous condition from the standpoint of wear of the thermal head.

To reduce wear of a thermal head, it is generally attempted to add a small amount of coarse grains (hereinafter referred to on occasion as a matting agent) to a protective layer of a heat-sensitive recording material to make the area of contact between the thermal head and the heat-sensitive recording material smaller or to add various types of lubricants to decrease the friction coefficient between the thermal head and the heat-sensitive recording material.

However, the addition of a matting agent adversely affects tight contact between the thermal head and the heat-sensitive recording material to cause uneven heat transfer during printing. Therefore, reproducibility of dots in the color developed area decreases to form uneven density in images and it not preferable that this method is used for a recording medium for producing high quality images such as a medical recording medium. When a lubricant is added, the added lubricant adheres to the thermal head, resulting in damage and uneven densities of the recording medium. Therefore, the addition of a lubricant is not preferable.

SUMMARY OF THE INVENTION

An object of the present invention is to provide a heat-sensitive recording material which causes little wear of a thermal head, shows excellent reproducibility of dots of images and provides high quality images without uneven densities, formation of blurred images or missing portions in the images to overcome the above problems of the thermal head and the quality of images.

The heat-sensitive recording material of the present invention comprises a substrate, a heat-sensitive recording layer disposed on the substrate and a protective layer, which contains a binder and a pigment as main components, disposed on the heat-sensitive recording layer. As the result of extensive studies by the present inventors with attention particularly paid to the protective layer of the heat-sensitive recording material, it was found that wear of a thermal head can be decreased remarkably without adding a matting agent or a lubricant to the protective layer when the protective layer comprises a pigment which contains particles having a volume average particle diameter of 0.300 $\mu$m or less in a portion of 50% by volume of the total volume of the particles as measured by a laser diffraction method and which contains 3% or less of particles having a diameter of 1.0 $\mu$m or more in a total amount of particles and the surface of the protective layer has a central line value Ra of the surface roughness of 0.3 $\mu$m or less in a frequency component having a roughness pitch of 2 to 10 $\mu$m of the surface roughness in the entire frequency range. The present invention has been completed on the basis of this knowledge.

The object of the present invention can be achieved by the following heat-sensitive recording material.

The heat-sensitive recording material of the present invention comprises a substrate, a heat-sensitive recording layer disposed on the substrate and a protective layer disposed on the heat-sensitive recording layer, wherein the protective layer comprises a pigment which contains particles having a volume average particle diameter of 0.300 μm or less in a portion of 50% of the total volume of the particles as measured by a laser diffraction method and which contains 3% or less of particles having a diameter of 1.0 μm or more in the total amount of particles and the surface of the protective layer has a central line value Ra of the surface roughness of 0.3 μm or less in the frequency component having a roughness pitch of from 2 to 10 μm of the surface roughness in the entire frequency range.

It is preferable that, in the heat-sensitive recording material of the present invention, the volume average particle diameter is in the range of 0.200 to 0.300 μm in a portion of 50% of the total volume of the particles.

It is preferable that, in the heat-sensitive recording material of the present invention, the energy required to obtain a transmission density of of $D_T3.0$ is 90 to 150 mJ/mm$^2$ in a color developed area.

It is preferable that, in the heat-sensitive recording material of the present invention, the pigment in the protective layer is an inorganic pigment selected from the group consisting of calcium carbonate, titanium oxide, kaolin, aluminum hydroxide, amorphous silica and zinc oxide.

It is preferable that, in the heat-sensitive recording material of the present invention, the pigment in the protective layer is an organic pigment selected from the group consisting of urea-formaldehyde resins and epoxy resins.

It is preferable that, in the heat-sensitive recording material of the present invention, the heat-sensitive recording layer comprises at least one electron-donating dye precursor selected from the group consisting of triphenylmethane phthalide compounds, fluoran compounds, phenothiazine compounds, indolyl phthalide compounds, leuko auramine compounds, rhodamine lactum compounds, triphenylmethane compounds, triazene compounds, spiropyran compounds and fluorene compounds and at least one electron-accepting compound selected from the group consisting of phenol compounds, organic acids, salts of organic acids and oxybenzoates.

It is preferable that, in the heat-sensitive recording material of the present invention, the electron-donating dye precursor is present in a hydrophobic organic solvent in a core of each microcapsule.

It is preferable that, in the heat-sensitive recording material of the present invention, the heat-sensitive recording layer comprises a photodecomposable diazo compound selected from the group consisting of aromatic diazonium compounds, diazosulfonate compounds and diazoamino compounds and a coupler, the aromatic diazonium compound being represented by the following general formula:

$$Ar-N_2^+X^-$$

wherein Ar represents a substituted or unsubstituted aromatic hydrocarbon ring group, $N_2^+$ represents a diazonium group and $X^-$ represents an acid anion.

It is preferable that, in the heat-sensitive recording material of the present invention, the photodecomposable diazonium compound is present in a hydrophobic organic solvent in a core of each microcapsule.

DESCRIPTION OF THE PREFERRED EMBODIMENTS

The heat-sensitive recording material comprises a substrate, a heat-sensitive recording layer disposed on the substrate and a protective layer disposed on the heat-sensitive recording layer.

(Protective Layer)

The protective layer comprises at least a pigment and a binder.

The protective layer in the heat-sensitive recording material of the present invention may have a single layer structure or a laminate structure having two or more layers. The protective layer comprises a specific pigment described later. The pigment is generally used to perform the recording by a thermal head more advantageously. Specifically, the pigment is used to reduce sticking and generation of noise. An inorganic and/or organic pigment is used in combination with the binder.

As the pigment used in the protective layer of the heat-sensitive recording material of the present invention, a pigment containing particles having a volume average particle diameter of 0.300 μm or less in a portion of 50% by volume in the total volume of the particles as measured by laser diffraction is used. The volume average particle diameter in a portion of 50% of the total volume of the particles means an average diameter of particles of a pigment in an amount corresponding to 50% by volume of the total volume of the pigment and is measured by an apparatus for measuring distribution of particle diameters by laser diffraction, LA700 manufactured by Horiba Ltd. Hereinafter, the average particle diameter in a portion of 50% of the total volume of the particles will be occasionally simply referred to as the average particle diameter. It is more preferable that the volume average particle diameter in a portion of 50% of the total volume of the particles is in the range of 0.200 to 0.300 μm to prevent sticking and generation of noise between a thermal head and the heat-sensitive recording material during recording by using the thermal head.

When the average particle diameter in a portion of 50% of the total volume of the particles exceeds 0.300 μm, the effect of reducing wear of a thermal head decreases. When the average particle diameter is less than 0.200, the effect of addition of a pigment, i.e., the effect of preventing adhesion due to fusing the binder in the protective layer to the thermal head, decreases and, as a result, so-called sticking, i.e., adhesion of the heat-sensitive recording material to the thermal head, takes place during printing. Therefore, such average particle diameters are not preferable.

As the pigment used in the protective layer of the heat-sensitive recording material of the present invention, a pigment which has an average particle diameter in the above range and, moreover, contains 3% or less of particles having a diameter of 1.0 μm or more in the total amount of the particles, is used. As the average particle diameter of the pigment, which corresponds to the average particle diameter in a portion of 50% by volume of the entire pigment, is reduced to the range specified in the present invention, it is effective for reducing wear of a thermal head and obtaining high quality images if the content of particles having larger diameters in the pigment is also reduced to the range specified in the present invention.

When the content of particles having a diameter of 1 μm or more in the total particles exceeds 3%, problems similar to problems caused by a marked increase in the amount of the pigment arise in that transparency of the heat-sensitive recording material itself deteriorates and blurred images are formed even when the volume average particle diameter of the pigment is held at 0.300 μm or less in a portion of 50% of total volume of particles to reduce wear of a thermal head. Therefore, such a content is not preferable.

The pigment used in the protective layer of the present invention is not particularly limited and conventional organic and inorganic pigments can be used. Preferable examples of the pigment include inorganic pigments such as calcium carbonate, titanium oxide, kaolin, aluminum hydroxide, amorphous silica and zinc oxide; and organic pigments such as urea-formaldehyde resins and epoxy resins. More preferable examples among these pigments include kaolin, aluminum hydroxide and amorphous silica. A single type of the pigment or a combination of two or more types of the pigments may be used. The pigments obtained by treating the surface of the particles of the above pigments with metal salts of higher fatty acids, amides of higher fatty acids, esters of high fatty acids or higher aliphatic hydrocarbons may also be used.

The pigment is dispersed by a conventional dispersing machine such as a dissolver, a sand mill, or a ball mill in the presence of an auxiliary dispersant such as sodium hexametaphosphate, partially or fully saponified modified polyvinyl alcohol, copolymers of acrylic acid, and various types of surfactants, preferably a partially or fully saponified modified polyvinyl alcohol or an ammonium salt of a copolymer of acrylic acid in such a manner that the average particle diameter has the value specified in the present invention and then used. In other words, the pigment is dispersed so that the volume average particle diameter in a portion of 50% of the total volume of the pigment particles is in the range of 0.200 to 0.300 μm and is then used.

The heat-sensitive recording material of the present invention comprises the protective layer having the surface roughness in the range specified in the present invention. The protective layer has a central line value Ra of the surface roughness of 0.3 μm or less in the range of a frequency component from 2 to 10 μm in the entire frequency range of the surface of the protective layer after being coated and dried. It is preferable that Ra indicating the surface roughness of the protective layer is in the range of 0.1 to 0.3 μm.

Even when the heat-sensitive recording material has the protective layer comprising a pigment which contains particles having a volume average particle diameter of 0.300 or less in a portion of 50% of total volume of the particles and which contains 3% or less of particles having a particle diameter of 1.0 mm or less in the total amount of the particles, wear of a thermal head cannot be reduced sufficiently and defects are formed in images when the value of Ra described above exceeds 0.3 μm. When the value of Ra exceeds 0.3 μm, the dispersion of the pigment used for a coating fluid or the coating liquid for the protective layer is unstable. Agglomeration of the components may take place during coating and drying. Therefore, such a value of Ra is not preferable.

"The central line value Ra of a surface roughness of a frequency component having a roughness pitch of 2 to 10 μm" means a volume of particle diameter at a position of a central line (i.e., Ra) obtained from a set of roughness degrees in a frequency component of 2 to 10 μm, which is obtained by filtering the measured surface roughness in the entire frequency range by means of a frequency cut filter to cut off frequency ranges of 2 μm or less and 10 μm or more. When the value of Ra is great, protruded portions which directly hit the head exist on the surface of the layer. When these portions hit the head, instantaneous resistance applied to the thermal head increases and wear of the thermal head is accelerated.

To achieve excellent transparency, it is preferable that fully saponified polyvinyl alcohol, polyvinyl alcohol modified with a carboxyl group or polyvinyl alcohol modified with silica is used for the protective layer. The protective layer may contain conventional film hardeners and metal soaps.

To form a uniform protective layer on the heat-sensitive recording layer, it is preferable that a surfactant is added to a coating fluid for the protective layer. Examples of the surfactant include alkali metal salts of sulfosuccinic acid and fluorine-containing surfactants. Specific examples of the surfactant include sodium salts or ammonium salts of di(2-ethylhexyl) sulfosuccinate and di-(n-hexyl) sulfosuccinate.

To the protective layer, surfactants, fine particles of metal oxides, inorganic electrolytes and macromolecular electrolytes may be added to prevent electrostatic charge on the heat-sensitive recording material.

The coated amount of the dried protective layer is preferably 0.2 to 7 g/m$^2$ and more preferably 1 to 4 g/m$^2$.

(Heat-sensitive Recording Layer)

The heat-sensitive recording layer in the heat-sensitive recording material of the present invention may have any composition as along as the layer has an excellent transparency before color development and develops color by heating.

Examples of the heat-sensitive recording layer include so-called two-component heat-sensitive recording layers containing a substantially colorless color forming component A and a substantially colorless color forming component B which develops color by reaction with the color forming component A. Examples of the combination of two components constituting the two-component heat-sensitive recording layer include the following combinations (a) to (m):

(a) Combinations of electron-donating dye precursors with electron-accepting compounds.

(b) Combinations of photodecomposable diazo compounds with couplers.

(c) Combinations of organic metal salts such as silver behenate and silver stearate with reducing agents such as protocatechuic acid, spiroindane and hydroquinone.

(d) Combinations of long chain aliphatic salts such as iron(II) stearate and iron(II) myristate with phenols such as salts of gallic acid and ammonium salicylate.

(e) Combinations of heavy metal salts of organic acids such as nickel, cobalt, lead, copper, iron, mercury or silver salt of acetic acid, stearic acid and palmitic acid with alkaline earth metal sulfides such as calcium sulfide, strontium sulfide and potassium sulfide, or combinations of the above heavy metal salts of organic acids with organic chelating agents such as s-diphenylcarbazide and diphenylcarbozone.

(f) Combinations of metal sulfates such as silver sulfide, lead sulfide, mercury sulfide and sodium sulfide with sulfur compounds such as sodium teterathionate, sodium thiosulfate and thiourea.

(g) Combinations of aliphatic iron(II) salts such as iron(II) stearate with aromatic polyhydroxy compounds such as 3,4-dihydroxytetraphenylmethane.

(h) Combinations of organic noble metal salts such as silver oxalate and mercury oxalate with organic polyhydroxy compounds such as polyhydroxyalcohols, glycerol and glycol.

(i) Combinations of aliphatic iron(II) salts such as iron(II) peralgonate and iron(II) laurate with derivatives of thiocetylcarbamide and isothiocetylcarbamide.

(j) Combinations of lead salts of organic acids such as lead caproate, lead peralgonate and lead behenate with derivatives of thiourea such as ethylenethiourea and N-dodecylthiourea.

(k) Combinations of heavy metal salts of higher fatty acids such as iron(II) stearate and copper stearate with zinc dialkyldithiocarbamates.

(l) Combinations forming oxazine dyes such as combinations of resorcinol and nitroso compounds.

(m) Combinations of formazane compounds with reducing agents and/or metal salts.

In the heat-sensitive recording material of the present invention, combinations (a) of electron-donating dye precursors with electron-accepting compounds, combinations (b) of photodecomposable diazo compounds with couplers and combinations (c) of organic metal salts with reducing agents are preferable. Combinations (a) of electron-donating dye precursors with electron-accepting compounds and combinations (b) of photodecomposable diazo compounds with couplers are more preferable.

In the heat-sensitive recording material, images having excellent transparency can be obtained by forming a heat-sensitive recording layer so as to have a decreased haze value which is obtained from the calculation (diffused light transmittance/total light transmittance)×100 (%). The haze value is an index showing the transparency of a material and is generally calculated from the total light transmittance, the diffused light transmittance and the specular light transmittance obtained by using a haze meter.

In the present invention, the haze value can be decreased by a method in which the volume average particle diameter in a portion of 50% by volume of both of fine particle components A and B contained in the heat-sensitive recording layer is adjusted to 1.0 μm or less and preferably to 0.6 μm or less and a binder is contained in an amount in the range of 30 to 60% by weight of the total solid components of the heat-sensitive recording layer or by a method in which one of the fine particle components A and B is microencapsuled and the other is used in a form which forms a substantially continuous layer after application and drying, for example, in the form of an emulsion.

It is also effective if the refractivity indices of the components used in the heat-sensitive recording layer are adjusted to be as close to a specific value as possible.

Combinations (a), (b) and (c) which are preferably used in the heat-sensitive recording layer of the heat-sensitive recording material of the present invention are described in more detail in the following.

(a) The heat-sensitive recording layer using the combination of an electron-donating dye precursor and an electron-accepting compound is described in the following.

The electron-donating dye precursor of the present invention (hereinafter referred to on occasion as the color forming agent) is not particularly limited as long as the precursor is substantially colorless. The electron-donating dye precursor is a compound having the property of developing color by donating an electron or by accepting a proton from an acid or the like. A colorless compound having a partial skeleton structure of lactone, lactum, sultone, spiropyran, ester or amide which causes open ring or cleavage of the structure when the compound is brought into contact with an electron-accepting compound, i.e., a developer, is preferably used.

Examples of the electron-donating dye precursor include triphenylmethane phthalide compounds, fluoran compounds, phenothiazine compounds, indolyl phthalide compounds, leuko auramine compounds, rhodamine lactum compounds, triphenylmethane compounds, triazene compounds, spiropyran compounds and fluorene compounds.

Specific examples of the phthalide compound include compounds described in the specifications of U.S. Reissued Pat. No. 23,024 and U.S. Pat. Nos. 3,491,111, 3,491,112, 3,491,116 and 3,509,174.

Specific examples of the fluoran compound include compounds described in the specifications of U.S. Pat. Nos. 3,624,107, 3,627,787, 3,641,011, 3,462,828, 3,681,390, 3,920,510 and 3,959,571.

Specific examples of the spirodipyran compounds include compounds described in the specification of U.S. Pat. No. 3,971,808.

Specific examples of the pyridine compound and the pyrazine compound include compounds described in the specifications of U.S. Pat. Nos. 3,775,424, 3,853,869 and 4,246,318.

Specific examples of the fluorene compound include compounds described in Japanese Patent Application No. 61-240989.

2-Arylamino-3-[H, halogen, alkyl or alkoxy-6-substituted aminofluorans] which form black color are effective among the above compounds.

Specific examples of the above compound include 2-anilino-3-methyl-6-diethylaminofluoran, 2-anilino-3-methyl-6-N-cyclohexyl-N-methylaminofluoran, 2-p-chloroanilino-3-methyl-6-dibutylaminofluoran, 2-anilino-3-methyl-6-dioctylaminofluoran, 2-anilino-3-chloro-6-diethyl-aminofluoran, 2-anilino-3-methyl-6-N-ethyl-N-isoamylaminofluoran, 2-anilino-3-methyl-6-N-ethyl-N-dodecylaminofluoran, 2-anilino-3-methoxy-6-dibutylaminofluoran, 2-o-chloroanilino-6-dibutylaminofluoran, 2-p-chloroanilino-3-ethyl-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-o-toluidino-3-methyl-6-diisopropylaminofluoran, 2-anilino-3-methyl-6-N-isobutyl-N-e thylamino-fluoran, 2-anilino-3-methyl-6-N-ethyl-N-tetrahydrofurfurylaminofluoran, 2-anilino-3-chloro-6-N-ethyl-N-isoamylaminofluoran, 2-anilino-3-methyl-6-N-methyl-N-γ-ethoxypropylaminofluoran, 2-anilino-3-methyl-6-N-ethyl-N-γ-ethoxypropylaminofluoran and 2-anilino-3-methyl-6-N-ethyl-N-γ-propoxypropylaminofluoran.

As the electron-accepting compound, i.e., the developer, which interacts with the above electron-donating dye precursor, acidic compounds such as phenol compounds, organic acids, salts of organic acids and esters of oxybenzoic acid are used. Examples of the electron-accepting compound include compounds described in Japanese Patent Laid-Open (hereinafter abbreviated as JP-A) No. 61-291183.

Specific examples of the electron-accepting compound include:

bisphenols such as 2,2-bis(4'-hydroxyphenyl)propane (bisphenol A), 2,2-bis(4'-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-2-methylpentane, 1,1-bis(4'-hydroxyphenyl)-2-ethylhexane, 1,1-bis(4'-hydroxyphenyl)dodecane, 1,4-bis(p-hydroxyphenylcumyl)benzene, 1,3-bis(p-hydroxyphenylcumyl)benzene, bis(p-hydroxyphenyl)sulfone, bis(3-allyl-4-hydroxyphenyl)sulfone and benzyl bis(p-hydroxyphenyl)acetate;

derivatives of salicylic acid such as 3,5-di-α-methylbenzylsalicylic acid, 3,5-di-tert-butylsalicyllic acid, 3-α,α-dimethylbenzylsalicylic acid and 4-(β-p-methoxyphenoxyethoxy)salicylic acid;

salts of the derivatives of salicylic acid with multi-valent metals particularly zinc and aluminum; esters of oxybenzoic acid such as benzyl p-hydroxybenzoate, 2-ethylhexyl p-hydroxybenzoate, 2-phenoxyethyl β-resorcylate; and phenols such as p-phenylphenol, 3,5-diphenylphenol, cumylphenol, 4-hydroxy-4'-isopropoxydiphenylsulfone and 4-hydroxy-4'-phenoxydiphenylsulfone.

Bisphenols are preferable among these compounds from the standpoint of obtaining an excellent color developing property.

A single type or a combination of two or more types of the above electron-accepting compounds may be used.

The developer is preferably used in an amount in the range of 50 to 800% by weight and more preferably in the range of 100 to 500% by weight of the amount of the color forming agent. A single type or a combination of two or more types of the above developers may be used.

(b) The heat-sensitive recording layer using the combination of a photodecomposable diazo compound and a coupler is described in the following.

The photodecomposable diazo compound develops a desired color by the coupling reaction with a developer which is a coupling component described later. When light having a wavelength in a specific range is irradiated to the photodecomposable diazo compound before the coupling reaction, the photodecomposable diazo compound is decomposed and loses the ability to develop color even in the presence of the coupling component.

The color hue of this coloring system is decided by the diazo dye produced by the reaction of the diazo compound with the coupling component. Therefore, the developed hue can be changed easily by changing the chemical structure of the diazo compound or the coupling component. Thus, a desired hue can be obtained by selecting a suitable combination of the diazo compound and the coupling component.

As the photodecomposable diazo compound used in the present invention, in particular, aromatic diazo compounds are preferable. Specifically, aromatic diazonium salts, diazosulfonate compounds and diazoamino compounds are preferable.

The aromatic diazonium salt is a compound represented by the following formula:

$$Ar—N_2^+X^-$$

wherein Ar represents a substituted or unsubstituted aromatic hydrocarbon ring group, $N_2^+$ represents a diazonium group and $X^-$ represents an acid anion. The aromatic diazonium compound is not particularly limited. Aromatic diazonium compounds which show an excellent photofixing property, cause little color stains after fixing and form a stable color developed portion are preferably used.

Many diazosulfonate compounds are recently known and can be obtained by treating corresponding diazonium salts with a sulfite. These compounds are advantageously used in the heat-sensitive recording material of the present invention.

The diazoamino compound can be obtained by coupling a diazo group with dicyandiamide, sarcosine, methyltaurine, N-ethylanthranic acid-5-sulfonic acid, monoethanolamine, diethanolamine or guanidine and is advantageously used in the heat-sensitive recording material of the present invention.

These diazo compounds are described in detail, for example, in JP-A 2-136286.

Examples of the coupling component, i.e., the coupler, which is used for the coupling reaction with the above diazo compound include 2-hydroxy-3-naphthoic acid anilide, resorcinol and other compounds described in JP-A 62-146678.

When the diazo compound and the coupling component are used in combination in the heat-sensitive recording layer of the heat-sensitive recording material of the present invention, a basic substance may be added as the sensitizer to accelerate the reaction by carrying out the coupling reaction in a basic atmosphere.

As the basic substance, a basic substance which is insoluble or slightly soluble in water or which generates an alkali upon heating can be used. Examples of the basic substance include compounds containing nitrogen such as inorganic and organic ammonium salts, organic amines, amides, urea, thiourea, derivatives of urea and thiourea, thiazoles, pyrrols, pyrimidines, piperazines, guanidines, indols, imidazoles, imidazolines, triazoles, morpholines, piperidines, amidines, formazines and pyridines.

Specific examples of these compounds include compounds described in JP-A 61-291183.

(c) The heat-sensitive recording layer using the combination of a organic metal salt and a reducing agent is described in the following.

Specific examples of the organic metal salt include silver salts of long chain aliphatic carboxylic acids such as silver laurate, silver myristate, silver palmitate, silver stearate, silver arachate and silver behenate; silver salts of organic compounds having imino group such as silver salt of benzotriazole, silver salt of benzimidazole, silver salt of carbazole and silver salt of phthaladinone; silver salts of compounds containing sulfur such as s-alkyl thioglycolates; silver salts of aromatic carboxylic acids such as silver benzoate and silver phthalate; silver salts of sulfonic acids such as silver ethanesulfonate; silver salts of sulfinic acids such as silver o-toluenesulfinate; silver salts of phosphoric acids such as silver phenylphosphate; silver barbiturate; silver saccharinate; the silver salt of salicylaldoxim; and mixtures of these compounds.

Among the above compounds, silver salts of long chain aliphatic carboxylic acids are preferable and silver behenate is more preferable. Behenic acid may be used in combination with silver behenate.

As the reducing agent, suitable compounds may be used with reference to the descriptions from the 14th line in the lower left column of page 227 to the 11th line in the upper right column of page 229 in the specification of JP-A 53-1020. Among such compounds, mono-, bis-, tris- and tetrakis-phenols, mono- and bis-naphthols, di- and polyhydroxynaphthalenes, di- and polyhydroxybenzenes, hydroxymonoethers, ascorbic acids, 3-pyrazolidones, pyrazolines, pyrazolones, reducing sugars, phenylenediamines, hydroxylamines, reductons, hydroxamines, hydrazides, amidoximes and N-hydroxyureas are preferably used.

Among the above compounds, aromatic reducing agents such as polyphenols, sulfonamidophenols and naphthols are more preferable.

The above organic metal salt or the above reducing agent is added in the form of fine particles having a volume average diameter of 1.0 μm or less and preferably of 0.6 μm or less in a portion of 50% by volume to a binder such as polyvinyl butyral dissolved in a suitable solvent such as acetone. It is also preferable that the binder is used in an amount in the range of 30 to 60% by weight of the total solid components in the heat-sensitive recording layer.

To surely achieve the sufficient transparency of the heat-sensitive recording material, it is preferable that the combination (a) of the electron-donating dye precursor and the electron-accepting compound or the combination (b) of the photodecomposable diazo compound and the coupler is used for the heat-sensitive recording layer. It is more preferable that the electron-donating dye precursor in combination (a) and the photodecomposable diazo compound in combination (b) are used in the form of microcapsules.

The process for producing the microcapsule is described in the following.

Microcapsules can be produced by interfacial polymerization, internal polymerization, external polymerization or the like process and any of these processes can be used. The interfacial polymerization is particularly preferable. The interfacial polymerization is carried out as follows: an oil phase is prepared by dissolving or dispersing the electron-donating dye precursor or the photodecomposable diazo compound in a hydrophobic organic solvent which forms the core of the capsule; the prepared oil phase is mixed with an aqueous phase in which a water-soluble polymer is dissolved; the two phases are dispersed with each other by a means such as a homogenizer; a polymer substance is formed at the interface of the oil droplets by the reaction induced by heating; and the wall of microcapsules of the polymer is formed.

The reactants for forming the polymer substance are added to the inside and/or the outside of the oil droplets. Specific examples of the polymer substance include polyurethanes, polyureas, polyamides, polyesters, polycarbonates, urea-formaldehyde resins, melamine resins, polystyrene, styrene-methacrylate copolymers and styrene-acrylate copolymers. Among these polymer substances, polyurethanes, polyureas, polyamides, polyesters and polycarbonates are preferable and polyurethanes and polyureas are more preferable. A single type or a combination of two or more types of the polymer may be used.

Examples of the water-soluble polymer include gelatin, polyvinylpyrrolidone and polyvinyl alcohol.

For example, when a polyurea is used as the wall material of the microcapsule, the wall of the microcapsule can be easily formed by allowing to react a polyisocyanate such as a diisocyanate, a triisocyanate, a tetraisocyanate and a polyisocyanate prepolymer with a polyamine such as a diamine, a triamine and a tetramine, a prepolymer having two or more amino groups, piperadine, a derivative of piperadine or a polyol in the aqueous phase by the interfacial polymerization method.

A composite wall composed of a polyurea and a polyamide or a composite wall composed of a polyurethane and a polyamide can be prepared by mixing a polyisocyanate, for example, with a second substance which forms the capsule wall by reaction with the polyisocyanate such as an acid chloride, a polyamine and a polyol in an aqueous solution of a water-soluble polymer (the aqueous phase) or in an oil medium (the oil phase) which forms the capsule dispersing the mixed components to prepare an emulsion and heating the prepared emulsion. The process for preparing the composite wall composed of a polyurea and a polyamide is described in detail in JP-A 58-66948.

Metal-containing dyes, electric charge controlling agents such as nigrosin and other optional additives can be contained in the microcapsule wall prepared in the present invention, where necessary. These additives can be added to the wall during formation of the capsule wall or at any other desired step. A monomer such as a vinyl monomer may be graft polymerized to the wall to control the electric charge at the surface of the wall, if necessary.

It is preferable that a plasticizer suitable for the polymer used as the wall material is used to obtain a microcapsule wall exhibiting excellent permeation of substances at lower temperatures and having an excellent color developing property. The plasticizer preferably has a melting point of 50° C. or higher and more preferably a melting point of 120° C. or lower. Among such plasticizers, a solid plasticizer at an ordinary temperature can be suitably selected and used.

For example, when the wall material is a polyurea or a polyurethane, hydroxy compounds, esters of carbamic acid, aromatic alkoxy compounds, organic sulfonamides, aliphatic amides and arylamides are preferably used.

In the preparation of the oil phase, an organic solvent having a boiling point of 100 to 300° C. is preferably used as the hydrophobic organic solvent used for dissolving the electron-donating dye precursor or the photodecomposable diazo compound and for forming the core of the microcapsule. Examples of the organic solvent include esters, dimethylnaphthalene, diethylnaphthalene, diisopropylnaphthalene, dimethylbiphenyl, diusopropylbiphenyl, diisobutylbiphenyl, 1-methyl-1-dimethylphenyl-2-phenylmethane, 1-ethyl-1-dimethylphenyl-1-phenyl-methane, 1-propyl-1-dimethylphenyl-1-phenylmethane, triarylmethanes such as tritoluylmethane and toluyldiphenylmethane, terphenyl compounds such as terphenyl, alkyl compounds, alkylated diphenyl ethers such as propyl diphenyl ether, hydrogenated terphenyl such as hexahydroterphenyl and diphenyl ether. Among these solvents, esters are preferably used from the standpoint of stability of the emulsion.

Examples of the esters include esters of phosphoric acid such as triphenyl phosphate, tricresyl phosphate, butyl phosphate, octyl phosphate and cresyl phenyl phosphate; esters of phthalic acid such as dibutyl phthalate, 2-ethylhexyl phthalate, ethyl phthalate, octyl phthalate and butyl benzyl phthalate; dioctyl tetrahydrophthalate; esters of benzoic acid such as ethyl benzoate, propyl benzoate, butyl benzoate, isopentyl benzoate and benzyl benzoate; esters of abietic acid such as ethyl abietate and benzyl abietate; dioctyl adipate; isodecyl succinate; dioctyl azelate; esters of oxalic acid such as dibutyl oxalate and dipentyl oxalate; diethyl malonate; esters of maleic acid such as dimethyl maleate, diethyl maleate and dibutyl maleate; tributyl citrate; esters of sorbic acid such as methyl sorbate, ethyl sorbate and butyl sorbate; esters of sebacic acid such as dibutyl sebacate and dioctyl sebacate; esters of ethylene glycol such as monoesters and diestes with formic acid, monoesters and diesters with butyric acid, monoesters and diesters with lauric acid, monoesters and diesters with palmitic acid, monoesters and diesters with stearic acid and monoesters and diesters with oleic acid; triacetin; diethyl carbonate; diphenyl carbonate; ethylene carbonate; propylene carbonate; and esters of boric acid such as tributyl borate and tripentyl borate.

Among these esters, tricresyl phosphate is preferable because the emulsion obtained is the most stable when used both singly or in a mixture. The above oils can also be used in combination or in a combination with other oils.

When the solubility of the electron-donating dye precursor or the photodecomposable diazo compound used for the microcapsule in the above solvent is poor, a solvent having a lower boiling point and showing a better solubility can be used in combination as an auxiliary. Preferable examples of the auxiliary solvent include ethyl acetate, isopropyl acetate, butyl acetate and methylene chloride.

When the above electron-donating dye precursor or the above photodecomposable diazo compound is used in the heat-sensitive recording layer in the heat-sensitive recording material, the amount of the electron-donating dye precursor is preferably in the range of 0.1 to 5.0 g/m$^2$ and more preferably in the range of 1.0 to 3.5 g/m$^2$, and the amount of the photodecomposable diazo compound is preferably in the range of 0.02 to 5.0 g/m$^2$ and more preferably in the range of 0.10 to 4.0 g/m$^2$ from the standpoint of the density of developed color.

When the amount of the electron-donating dye precursor is less than 0.1 g/m$^2$ or the amount of the photodecomposable diazo compound is less than 0.02 g/m$^2$, a sufficient density of developed color is not occasionally obtained. When the amount of the electron-donating dye precursor or the photodecomposable diazo compound exceeds 5.0 g/m$^2$, transparency of the heat-sensitive recording layer occasionally deteriorates.

As the aqueous phase, an aqueous solution prepared by dissolving a water-soluble polymer is used. The above oil phase material is added to the above aqueous solution and dispersed to prepare an emulsion by a means such as a homogenizer. The water-soluble polymer works as a dispersing medium so that a uniformly dispersed emulsion can be obtained easily and the obtained emulsion is stable. A surfactant may be added to at least one of the oil phase and the aqueous phase to make the emulsion more uniformly dispersed and more stable. A conventional surfactant for emulsification can be used as the surfactant. When the surfactant is used, the amount of the surfactant is preferably 0.1 to 5% and more preferably 0.5 to 2% of the weight of the oil phase.

The water-soluble polymer contained as the protective colloid in the aqueous phase which is mixed with the oil phase can be suitably selected from conventional anionic polymer, nonionic polymer and amphoteric polymer. A water-soluble polymer having a solubility in water of 5% or more at the temperature of emulsification is preferable. Examples of such polymers include polyvinyl alcohol, modified polyvinyl alcohols, polyacrylamide, derivatives of polyacrylamide, ethylene-vinyl acetate copolymers, styrene-maleic anhydride copolymers, ethylene-maleic anhydride copolymers, isobutylene-maleic anhydride copolymers, polyvinylpyrrolidone, ethylene-acrylic acid copolymers, vinyl acetate-acrylic acid copolymers, derivatives of cellulose such as carboxymethylcellulose and methylcellulose, casein, gelatin, derivatives of starch, gum arabic and sodium alginate.

Among these polymers, polyvinyl alcohol, gelatin and derivatives of cellulose are particularly preferable.

It is preferable that the above water-soluble polymer has no or low reactivity with the isocyanate compounds. It is preferable that, when a substance having a reactive amino group in the molecular chain such as gelatin is used, the substance is modified in advance to remove the reactivity.

As the multi-valent isocyanate compound, compounds having 3 or more functional isocyanate groups are preferable. Bifunctional isocyanate compounds having two may be used in combination. Specific examples of the multi-functional isocyanate compound include dimers and trimers of diusocyanates such as xylylene diisocyanate, hydrogenated xylylene diisocyanate, hexamethylene diisocyanate, tolylene diisocyanate, hydrogenated tolylene diisocyanate and isophorone diisocyanate, such as biurets and isocyanurates, which are prepared by using the diisocyanates as the main material; multi-functional adducts of polyols such as trimethylolpropane with difunctional isocyanates such as xylylene diisocyanate; compounds prepared by introducing macromolecular compounds such as polyethers having active hydrogen atoms, such as polyethylene oxide, into adducts of polyols such as trimethylolpropane with difunctional diisocyanates such as xylylene diisocyanate; and condensation products of benzene isocyanate with formaldehyde.

The compounds described in JP-A 62-212190, JP-A 4-26189, JP-A 5-317694 and Japanese Patent Application No. 8-268721 are preferable as the multi-functional isocyanate compound.

The amount of the multi-functional isocyanate is decided so as to provide microcapsules having an average particle diameter in the range of 0.3 to 12 $\mu$m and a thickness of the wall in the range of 0.01 to 0.3 $\mu$m. The diameter of the dispersed particles is generally in the range of 0.2 to 10 $\mu$m.

Specific examples of the polyol and/or the polyamine which is added into the aqueous phase and/or the oil phase as a component which constitutes the wall of the microcapsule by reaction with the multi-functional isocyanate include propylene glycol, glycerol, trimethylolpropane, triethanolamine, sorbitol and hexamethylenediamine. A polyurethane microcapsule wall is formed when the polyol is added. To increase the reaction rate in the above reaction, it is preferable that the reaction temperature is kept high or that a suitable polymerization catalyst is added.

The multi-functional isocyanate, the polyol, the reaction catalyst and the polyamine used for forming a portion of the wall are described in detail in "Polyurethane Handbook" edited by KEIJI IWATA and published by NIKKAN KOGYO SHINBUN Co., Ltd. (1987).

As the surfactant added to the aqueous phase, surfactants which do not form precipitates or agglomerates by interaction with the above protective colloid can be suitably selected from anionic and nonionic surfactants.

Preferable examples of the surfactant include sodium alkylbenzene-sulfonates, sodium alkylsulfates, sodium salt of dioctyl sulfosuccinate and polyalkylene glycols such as polyoxythylene nonylphenyl ether.

The emulsion can be easily prepared from the oil phase containing the above components and the aqueous phase containing the protective colloid and the surfactant by a means generally used for micro-emulsification such as a high speed stirring and dispersion by ultrasonic vibration using a conventional emulsifying apparatus such as a homogenizer, a Manton Gaulin, an ultrasonic disperser, a dissolver and a KD mill. After the emulsification, the formed emulsion is heated to 30 to 70° C. to accelerate the reaction for forming the wall of the capsule. To prevent agglomeration of the capsules during the reaction, it is necessary that water is added to decrease the probability of collision between the capsules and that sufficient stirring is conducted.

An additional amount of the dispersion may be added during the reaction to prevent agglomeration. Generation of carbon dioxide is observed as the polymerization reaction proceeds and the formation of the wall of the capsule can be considered to be completed around the time when the formation of carbon dioxide ends. Microcapsules containing the object diazonium salt can be obtained generally after the reaction has continued for several hours.

When capsules are prepared using the electron-donating dye precursor or the photodecomposable diazo compound as the core material, the electron-accepting compound or the coupler may be used in the solid form in combination with the water-soluble polymer, the organic base and other components such as color forming auxiliary agents by dispersing by a means such as a sand mill. However, it is preferable that, after these components are dissolved into an organic solvent having a high boiling point which is insoluble or slightly soluble in water in advance, the resulting solution is mixed with an aqueous solution of the polymer (the aqueous phase) which contains the surfactant and/or the water-soluble polymer as the protective colloid and the resulting mixture is emulsified by a homogenizer or the like to prepare an emulsion. A solvent having a low boiling point can be used as an auxiliary agent for dissolution.

The coupler and the organic base may be emulsified separately or may be mixed together, dissolved into a solvent having a high boiling point and then emulsified. The diameter of the particles in the emulsion is preferably 1 μm or less.

When the electron-accepting compound is used in the heat-sensitive recording material of the present invention, the electron-accepting compound is preferably used in an amount in the range of 0.5 to 30 parts by weight and more preferably in the range of 1.0 to 10 parts by weight per 1 part by weight of the diazonium salt. When the coupler is used in the heat-sensitive recording material of the present invention, the coupler is used in an amount in the range of 0.1 to 30 parts by weight per 1 part by weight of the diazonium salt.

The organic solvent used above can be suitably selected, for example, from oils having a high boiling point which are described in JP-A 2-141279.

It is preferable from the standpoint of stability of the emulsion that esters are used from among these solvents. Tricresyl phosphate is particularly preferable. A combination of the oils described above or a combination of the oils described above and other oils may also be used.

The oil phase is mixed with the aqueous phase preferably in a ratio (the weight of the oil phase/the weight of the aqueous phase) of 0.02 to 0.6 and more preferably in a ratio of 0.1 to 4.0. When the ratio is less than 0.02, the emulsion is excessively dilute due to the excessive amount of the aqueous phase and the emulsion is not advantageous in the production. When the ratio exceeds 0.6, the emulsion has excessively high viscosity so as to cause inconvenience in handling and a decrease in the stability of the coating solution. Therefore, such ratios are not preferable.

It is preferable that the heat-sensitive recording layer in the heat-sensitive recording material of the present invention has a large dynamic range, i.e., a large energy range required to obtain the saturated transmission density $D_{T\text{-}max}$, to obtain high quality images by suppressing fluctuations in the density caused by slight differences in the thermal conductivity between heating elements in the head. In the heat-sensitive recording material of the present invention, the above heat-sensitive recording layer can exhibit a transmission density $D_T$ of 3.0 with a thermal energy in the range of 90 to 150 $mJ/mm^2$.

A binder is added to and mixed with the coating fluid for the heat-sensitive recording layer prepared as described above.

A binder soluble in water is generally used. Examples of the binder include polyvinyl alcohol, hydroxyethylcellulose, hydroxypropylcellulose, polyamides modified with epichlorohydrin, ethylene-maleic anhydride copolymers, styrene-maleic anhydride copolymers, isobutylene-maleic anhydride-salicylic acid copolymers, polyacrylic acid, polyacylamide, polyacrylamide modified with methylol group, derivatives of starch, casein and gelatin.

To provide the binder with resistance to water, an agent for providing resistance to water or an emulsion of a hydrophobic polymer, such as styrene-butadiene rubber latices and acrylic resin emulsions may be added.

To apply the coating solution for the heat-sensitive recording layer prepared above onto a substrate, a conventional method for coating a water-based coating solution or a organic solvent-based coating solution is used. In the heat-sensitive recording material of the present invention, methylcellulose, carboxymethylcellulose, hydroxyethylcellulose, starches, gelatin, polyvinyl alcohol, polyvinyl alcohol modified with carboxyl group, polyacrylamide, polystyrene, copolymers of styrene, polyesters, copolymers containing polyesters, polyethylene, copolymers of ethylene, epoxy resins, acrylate resins, copolymer resins of acrylates, methacrylate resins, copolymers of methacrylates, polyurethane resins, polyamide resins or polyvinyl butyral resins may be used to achieve safe and uniform application of the coating solution for the heat-sensitive recording layer onto the substrate and to maintain the strength of the resulting coated layer.

It is preferable that the heat-sensitive recording layer is formed so that the layer obtained after the coating solution is applied and dried has a weight of 1 to 25 $g/m^2$ and has a thickness of 1 to 25 μm.

Other components which can be used in the heat-sensitive recording layer will be described in the following.

The other components are not particularly limited and can be suitably selected in accordance with the object. For example, conventional heat melting substances, waxes, ultraviolet light absorbents and antioxidants can be used.

The heat melting substance may be contained in the heat-sensitive recording layer to improve the response to heat.

Typical examples of the heat melting substance include aromatic ethers, thioethers, esters, aliphatic amides and ureides. These compounds are described in JP-A 58-57989, JP-A 58-87094, JP-A 61-58789, JP-A 62-109681, JP-A 62-132674, JP-A 63-51478, JP-A 63-235961, JP-A 2-184489 and JP-A 2-215585.

The above wax preferably has a melting point in the range of 40 to 100° C. and an average particle diameter of 0.7 μm or less and more preferably of 0.4 μm or less in a portion of 50% by volume.

When the above average particle diameter exceeds 0.7 mm, transparency of the heat-sensitive recording layer deteriorates or obtained images become obscure. Therefore, such a diameter is not preferable.

When the melting point is lower than 40° C., the surface of the protective layer becomes tacky. When the melting point exceeds 100° C., sticking tends to occur. Therefore, such melting point are not preferable.

As the wax having a melting point of 40 to 100° C., petroleum waxes such as paraffin wax and microcrystalline wax, synthetic waxes such as polyethylene wax, plant waxes such as candelilla wax, carnauba wax and rice wax, animal waxes such as lanolin, mineral waxes such as montan wax, can be used. Among these waxes, paraffin wax having a melting point in the range of 55 to 75° C. is preferable.

The wax is used in an amount of 0.5 to 40% by weight and preferably of 1 to 20% by weight of the total amount of the protective layer. The wax may be used in combination with derivatives of 1,2-hydroxystearic acid or higher fatty acid amides.

To obtain a dispersion of the wax having the above-described average particle diameter in a portion of 50% by volume in the total volume of the particles, the wax may be dispersed by using a conventional wet type dispersing machine such as a dynomill and a sand mill in the presence of a suitable protective colloid and/or a suitable surfactant. A method in which wax is heated to melt and then emulsified by stirring at a high speed or by ultrasonic dispersion in a solvent in which the wax is insoluble or slightly soluble at a temperature higher than the melting point or a method in which the wax is dissolved in a suitable solvent and then emulsified in a solvent in which the wax is insoluble or slightly soluble, can also be used to obtain a dispersion having small particles. A suitable surfactant or a suitable protective colloid may be used in combination in the above methods.

As the above ultraviolet light absorbent, benzophenone ultraviolet light absorbents, benzotriazole ultraviolet light absorbents, salicylic acid ultraviolet light absorbents, cyanoacrylate ultraviolet light absorbents and oxalic acid anilide ultraviolet light absorbents can be advantageously used. Examples of the above ultraviolet light absorbents are described in JP-A 47-10537, JP-A 58-111942, JP-A 58-212844, JP-A 59-19945, JP-A 59-46646, JP-A 59-109055, JP-A 63-53544, JP-B 36-10466, JP-B 42-26187, JP-B 48-30492, JP-B 48-31255, JP-B 48-41572, JP-B 48-54965, JP-B 50-10726 and U.S. Pat. Nos., 2,719,086, 3,707,375, 3,754,919 and U.S. Pat. No. 4,220,711.

As the above antioxidant, hindered amine antioxidants, hindered phenol antioxidants, aniline antioxidants and quinoline antioxidants can be advantageously used. Examples of the above antioxidants are described in JP-A 59-155090, JP-A 60-107383, JP-A 60-107384, JP-A 61-137770, JP-A 61-139481 and JP-A 61-160287.

The above other components are preferably used in an amount of 0.05 to 1.0 g/m$^2$ and more preferably of 0.1 to 0.4 g/m$^2$. The other components may be contained in the inside or the outside of the microcapsule.

(Primer Layer)

In the heat-sensitive recording material of the present invention, it is preferable that the substrate is coated with a primer layer to prevent separation of the heat-sensitive recording layer from the substrate before the substrate is coated with the heat-sensitive recording layer containing the microcapsules and a layer for preventing light reflection.

For the primer layer, acrylic ester copolymers, polyvinylidene chloride, SBR and hydrophilic polyesters can be used. The thickness of the layer is preferably 0.05 to 0.5 $\mu$m.

When the heat-sensitive recording layer is coated on the primer layer, images recorded in the heat-sensitive recording layer are occasionally adversely affected by swelling of the primer layer caused by water contained in the coating solution for the heat-sensitive recording layer. Therefore, it is preferable that a hardening agent for the primer layer such as dialdehydes such as glutaraldehyde and 2,3-dihydroxy-1,4-dioxane and boric acid is used in the primer layer to harden the layer. The hardening agent can be used in an amount suitable for providing a desired hardness in the range of 0.2 to 3.0% by weight of the weight of the material of the primer layer.

The heat-sensitive recording material of the present invention can be produced by coating the substrate successively with the primer layer, the heat-sensitive recording layer and the protective layer by a conventional coating method such as blade coating, air knife coating, gravure coating, roll coating, spray coating, dip coating and bar coating.

(Substrate)

In the heat-sensitive recording material of the present invention, a transparent substrate is used so that a transparent heat-sensitive recording material is prepared. Examples of the transparent substrates include synthetic polymer films such as polyester films such as a polyethylene terephthalate film and a polybutylene terephthalate film, a cellulose triacetate film and a polyolefin film such as a polypropylene film and a polyethylene film. The above films can be used as a single film or a laminate of a plurality of films.

The thickness of the film of the synthetic polymer is preferably in the range of 25 to 250 $\mu$m and more preferably in the range of 50 to 200 $\mu$m.

The above the synthetic polymer films may be colored to a desired hue. As the method for coloring synthetic polymer films, a method in which a dye is mixed with a resin before preparation of a film and then a film is formed by using the colored resin, or a method in which a coating solution is prepared by dissolving a dye into a suitable solvent and the prepared coating solution is applied to a transparent colorless resin film by a conventional method such as gravure coating, roller coating and wire coating, can be used. A polyester resin film such as a polyethylene terephthalate film and a polyethylene naphthalate film prepared by mixing with a blue dye, forming into a film and then treated by a treatment for improving heat resistance, a stretching treatment and an antistatic treatment is preferably used.

When the transparent heat-sensitive recording material of the present invention is observed on an illuminating table with the substrate side facing the observer, images are occasionally difficult to discern due to haze formed by the light of the illuminating table passing through transparent portions having no images.

To prevent the above phenomenon, it is preferable that a synthetic polymer film which has a blue color in the quadrangular region formed by four points consisting of a point A (x=0.2805, y=0.3005), a point B (x=0.2820, y=0.2970), a point C (x=0.2885, y=0.3015) and a point D (x=0.2870, y=0.3040) on the chromaticity coordinates in accordance with the method described in Japanese Industrial Standard Z8701, is used as the transparent substrate.

A layer for preventing light reflection which contains fine particles having an average particle diameter of 1 to 20 $\mu$m and preferably of 1 to 10 $\mu$m may be formed on the surface of the substrate which is not coated with the heat-sensitive recording layer. The gloss measured at the incident angle of light of 20° is preferably adjusted to 50% or less and more preferably to 30% or less by forming the layer for preventing light reflection.

As the fine particles contained in the layer for preventing light reflection, fine particles of starch obtained from barley, wheat, corn, rice and beans; fine particles of synthetic polymers such as cellulose fibers, polystyrene resins, epoxy resins, polyurethane resins, urea-formaldehyde resins, poly (meth)acrylate resins, polymethyl (meth)acrylate resins, copolymer resins of vinyl chloride or vinyl acetate and polyolefins; and fine particles of inorganic substances such as calcium carbonate, titanium oxide, kaolin, smectite clay, aluminum hydroxide, silica and zinc oxide, can be used.

A single type or a combination of two or more types of the fine particulate substances can be used. It is preferable that the fine particulate substance has a refractivity index of 1.45 to 1.75 to achieve excellent transparency of the heat-sensitive recording material.

The heat-sensitive recording material of the present invention can be produced by forming, where necessary, the primer layer on the substrate before forming the heat-sensitive recording layer, then forming the heat-sensitive recording layer by applying the above coating solution for the heat-sensitive recording layer and drying the applied coating solution and forming the protective layer on the formed heat-sensitive recording layer.

EXAMPLES

The present invention will be described more specifically with reference to the following examples. However, the present invention is not limited to the examples. In the examples, concentrations are all expressed as % by weight.

Example 1

<Preparation of a coating solution of microcapsule A>

To 36 g of ethyl acetate, 19 g of a compound expressed by the following formula (1):

Chemical formula (1)

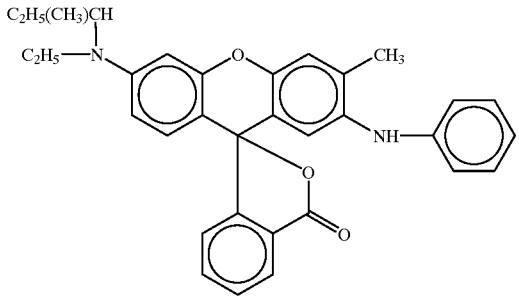

4.2 g of a compound expressed by the following formula (2):

Chemical formula (2)

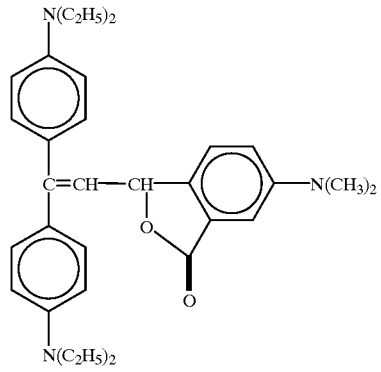

7.4 g of a compound expressed by the following formula (3):

Chemical formula (3)

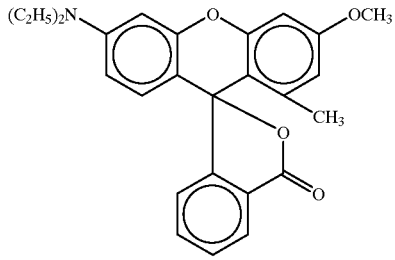

0.6 g of a compound expressed by the following formula (4):

Chemical formula (4)

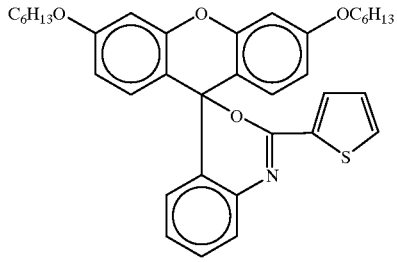

1.9 g of a compound expressed by the following formula (5):

Chemical formula (5)

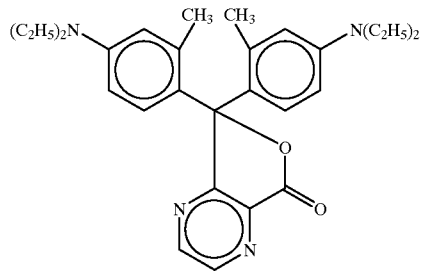

and 0.8 g of a compound expressed by the following formula (6):

Chemical formula (6)

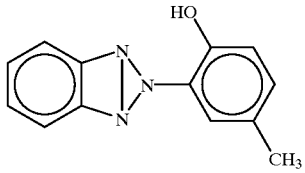

were added and dissolved by heating at 70° C. and the resulting solution was cooled to 35° C. To the cooled solution, 0.8 g of n-butanol, 11.2 g of a material for a capsule wall (trade name: TAKENATE D119N; manufactured by Takeda Chemical Industries, Ltd.), 4.1 g of a material for a capsule wall (trade name: TAKENATE D110N; manufactured by Takeda Chemical Industries, Ltd.) and 10.5 g of a material for a capsule wall (trade name: SUMIDUR N3200; manufactured by Sumitomo Bayer Urethane Co., Ltd.) were added and the obtained mixture was kept at 35° C. for 40 minutes.

The resulting solution was added to an aqueous phase which was prepared by mixing 26 g of water and 75 g of an 8% by weight aqueous solution of polyvinyl alcohol (trade name: PVA 217E; manufactured by Kuraray Co., Ltd.) and the obtained mixture was emulsified using an ACE HOMOGENIZER (manufactured by Nippon Seiki Co., Ltd.) at a rotation speed of 10,000 rpm for 5 minutes. To the obtained emulsion, 140 g of water and 1.0 g of tetraethylenepentamine were added and the resulting mixture was subjected to the reaction for formation of capsules at 50° C. for 3 hours to prepare a coating solution of microcapsule A having an average particle diameter of 0.7 μm.

The average particle diameter was measured in accordance with the following procedures: a pigment was dispersed in the presence of an auxiliary dispersant; the dispersion of the pigment immediately after being dispersed was diluted to the concentration of 0.5% by weight by adding water; the thus prepared solution for measuring was placed in water of 40° C.; after the light transmittance was adjusted to 75±1.0%, the solution for measuring was treated by ultrasonic vibration for 30 seconds and was subjected to measurement by an apparatus for measuring distribution of particle diameter by laser diffraction (trade name: LA700; manufactured by Horiba Ltd.); and the average particle diameter of the pigment particles in an amount corresponding to 50% by volume of the total volume of the pigment was used as the average particle diameter. All values of the average particle diameter shown in the following were obtained as described above.

<Preparation of a coating solution of microcapsule B>

To 36 g of ethyl acetate, 19 g of a compound expressed by the following formula (7):

Chemical formula (7)

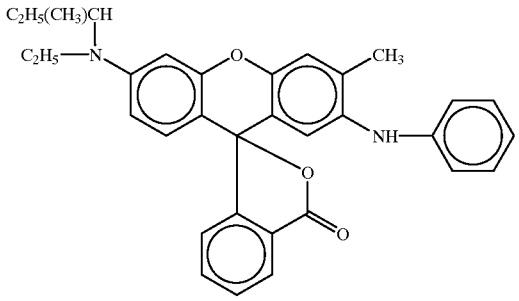

4.2 g of a compound expressed by the following formula (8):

Chemical formula (8)

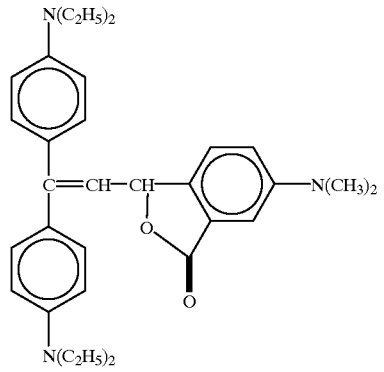

7.4 g of a compound expressed by the following formula (9):

Chemical formula (9)

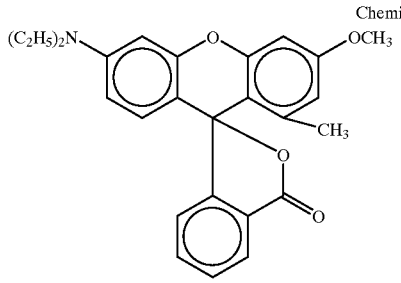

0.6 g of a compound expressed by the following formula (10):

Chemical formula (10)

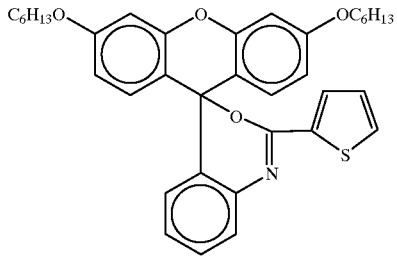

1.9 g of a compound expressed by the following formula (11):

Chemical formula (11)

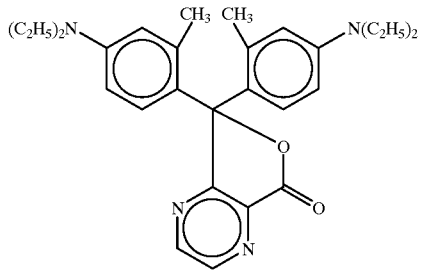

and 0.8 g of a compound expressed by the following formula (12):

Chemical formula (12)

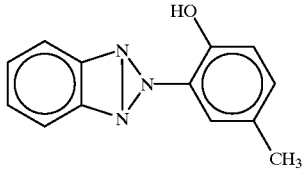

were added and dissolved by heating at 70° C. and the resulting solution was cooled to 30° C. To the cooled solution, 15.0 g of a material for a capsule wall (trade name: TAKENATE D110N; manufactured by Takeda Chemical Industries, Ltd.) and 10.4 g of a material for a capsule wall (trade name: BARNOCK D750; manufactured by Dainippon Ink & Chemicals, Inc.) were added and the obtained mixture was kept at 35° C. for 5 minutes.

The resulting solution was added to an aqueous phase which was prepared by mixing 26 g of water and 75 g of an 8% by weight aqueous solution of polyvinyl alcohol (trade name: PVA 217E; manufactured by Kuraray Co., Ltd.) and the obtained mixture was emulsified by ACE HOMOGENIZER (manufactured by Nippon Seiki Co., Ltd.) at a rotation speed of 10,000 rpm for 5 minutes. To the resulting emulsion, 140 g of water and 1.0 g of tetraethylenepentamine were added and the obtained mixture was subjected to the reaction for formation of capsules at 50° C. for 3 hours to prepare a coating solution of microcapsule B having an average particle diameter of 0.7 μm.

<Preparation of an emulsion for a developer C>

To 15 g of ethyl acetate, 3.4 g of a compound expressed by the following formula (13):

Chemical formula (13)

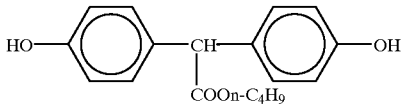

8.3 g of a compound expressed by the following formula (14):

Chemical formula (14)

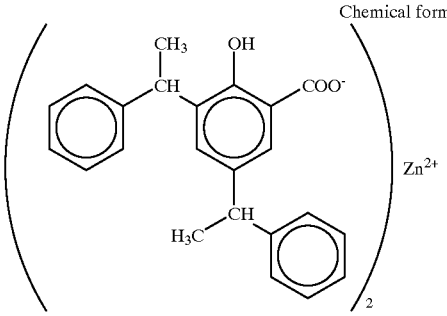

8.3 g of a compound expressed by the following formula (15):

Chemical formula (15)

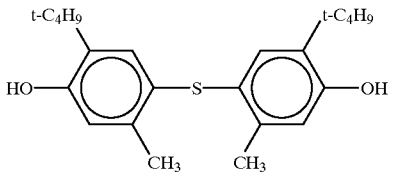

5.8 g of a compound expressed by the following formula (16):

Chemical formula (16)

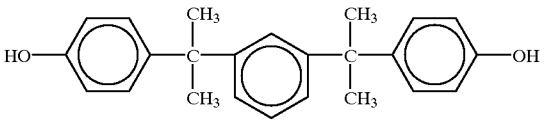

3.9 g of a compound expressed by the following formula (17):

Chemical formula (17)

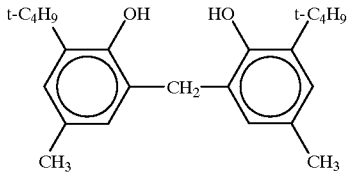

3.5 g of a compound expressed by the following formula (18):

Chemical formula (18)

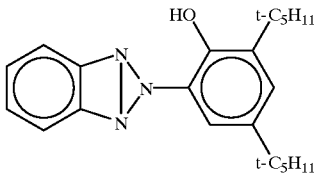

0.8 g of tricresyl phosphate and 0.4 g of diethyl maleate were added and dissolved by heating at 70° C.

The resulting solution was added to an aqueous phase which was prepared by mixing 40 g of a 15% by weight aqueous solution of polyvinyl alcohol (trade name: PVA 205C; manufactured by Kuraray Co., Ltd.), 9 g of a 2.0% by weight aqueous solution of sodium dodecylbenzene-sulfonate and 9.0 g of a 2% by weight aqueous solution of a compound expressed by the following formula (19):

Chemical formula (19)

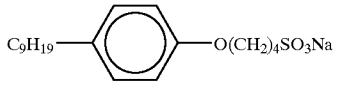

The resulting mixture was emulsified by ACE HOMOGENIZER (manufactured by Nippon Seiki Co., Ltd.) at a rotation speed of 10,000 rpm so that the average particle diameter became 0.7 μm and an emulsion of a developer C was prepared.

<Preparation of an emulsion of fine particles of wax D>

To 20.0 g of solid paraffin wax having a melting point of 68 to 70° C. (manufactured by Kanto Kagaku Co., Ltd.), 5.0 g of a surfactant of polyoxyethylene stearyl ether (trade name: KAO EMULGEN 320P; manufactured by Kao Corp.) was added and mixed with melting by heating to 75° C. The obtained mixture was added to 60 g of a 5% aqueous solution of polyvinyl alcohol (trade name: PVA 205C; manufactured by Kuraray Co., Ltd.) at 75° C. The resulting mixture was emulsified by ACE HOMOGENIZER (a trade name; manufactured by Nippon Seiki Co., Ltd.) at a rotation speed of 15,000 rpm so that the average particle diameter became 0.7 μm.

In the emulsification, the temperature of the homogenizer was maintained by circulating hot water of 85° C. around the homogenizer so that the emulsification was constantly conducted at a temperature of 75° C. or higher. After the emulsification was completed, 8.3 g of hot water was added and then the temperature of the solution was gradually decreased to an ordinary temperature to obtain a 30% by weight emulsion of fine particles of wax D.

<Preparation of a dispersion E of pigments for a protective layer>

To 110 g of water, 30 g of aluminum hydroxide (trade name: H42S; manufactured by Showa Denko K. K.) was added and the mixture was stirred for 3 hours. Then, 0.2 g of a dispersant (trade name: POISE 532A; manufactured by Kao Corp.), 30 g of a 10% aqueous solution of polyvinyl alcohol (trade name: PVA 105; manufactured by Kuraray Co., Ltd.) and 1.0 g of a 10% aqueous solution of sodium dodecylbenzene-sulfonate were added and the mixture was dispersed by a sand mill to obtain a dispersion E of pigment for a protective layer having an average particle diameter of 0.275 μm and a content of particles having a diameter of 1.0 μm or more of 2%.

<Preparation of a coating solution F for a protective layer>

To 20 g of water, 90 g of a 6% by weight aqueous solution of polyvinyl alcohol (trade name: PVA 124C; manufactured by Kuraray Co., Ltd.), 0.5 g of a 20.5% by weight dispersion of zinc stearate (trade name: F155; manufactured by Chukyo Yushi Co., Ltd.), 25 g of a 1.0% aqueous solution of boric acid, 3.0 g of the 30% by weight emulsion D of fine particles of wax prepared above, 60 g of the dispersion E of pigments for a protective layer prepared above, 5.0 g of a 30% dispersion of silicone oil in water (trade name: SH490; manufactured by Toray Dow Corning Co., Ltd.), 2.0 g of a 10% aqueous solution of sodium dodecylbenzene-sulfonate, 15 g of a 2% by weight aqueous solution of a compound expressed by the following formula (20):

$$C_8F_{17}SO_2N(C_3H_7)CH_2COOK \qquad \text{Chemical formula (20)}$$

and 1.0 g of a 40% aqueous solution of glyoxal were mixed together to obtain a coating solution F for a protective layer.

<Preparation of a microcapsule solution G for a ultraviolet light absorbing filter layer>

To 8.2 g of ethyl acetate, 1.58 g of a compound expressed by the following formula (21):

Chemical formula (21)

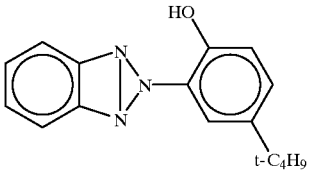

6.30 g of a compound expressed by the following formula (22):

Chemical formula (22)

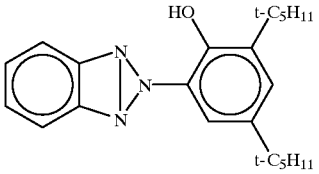

5.20 g of a compound expressed by the following formula (23):

Chemical formula (23)

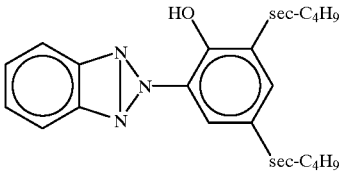

1.40 g of a compound expressed by the following formula (24):

Chemical formula (24)

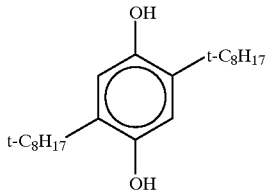

and 7.30 g of a compound expressed by the following formula (25):

$$O{=}P{-}(OCH_2CH_2CH(CH_3)CH_2C(CH_3)_2CH_3)_3 \qquad \text{Chemical formula (25)}$$

were added and dissolved by heating at 70° C. and the resulting solution was cooled to 35° C. To the cooled solution, 0.9 g of a material for a capsule wall (trade name: TAKENATE D110N; manufactured by Takeda Chemical Industries, Ltd.) and 0.3 g of a material for a capsule wall (trade name: BARNOCK D750; manufactured by Dainippon Ink & Chemicals, Inc.) were added and the obtained mixture was kept at 35° C. for 5 minutes. The prepared solution was added to an aqueous phase which was prepared by mixing 120 g of a 15% by weight aqueous solution of polyvinyl alcohol (trade name: PVA 205; manufactured by Kuraray Co., Ltd.) and 8.0 g of a 10% by weight aqueous solution of sodium dodecylbenzenesulfonate. The resulting mixture was emulsified by ACE HOMOGENIZER (manufactured by Nippon Seiki Co., Ltd.) at a rotation speed of 15,000 rpm for 15 minutes to obtain an emulsion having an average particle diameter of 0.25 μm.

To the resulting emulsion, 60 g of water and 0.15 g of tetraethylenepentamine were added and the obtained mixture was subjected to the reaction for formation of capsules at 40° C. for 3 hours to prepare a microcapsule solution G having an average particle diameter of 0.25 μm.

<Preparation of a coating solution H for an ultraviolet light absorbing filter layer>

To a solution prepared by dissolving 40.0 g of a 10% by weight solution of polyvinyl alcohol modified with silanol (trade name: R2105; manufactured by Kuraray Co., Ltd.) into 42.31 g of water, 13.5 g of the microcapsule solution G for ultraviolet light absorbing filter layer solid concentration: 24.2%) prepared above was added. To the resulting mixture, 17 g of a 50% by weight aqueous solution of a compound expressed by the following formula (26):

Chemical formula (26)

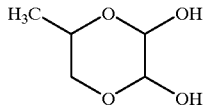

and 65 g of a 20% colloidal silica (trade name: SNOWTEX O; manufactured by Nissan Chemical Industries, Ltd.) were mixed to prepare a coating solution H for an ultraviolet light absorbing filter layer.

<Preparation of a coating solution I for a back coat layer>

To 50 g of water, 0.1 g of rice starch (manufactured by MATSUTANI KAGAKU Co., Ltd.) having an average particle diameter of 5 μm was added and sufficiently dispersed. To the obtained dispersion, 2.5 g of a 2% by weight aqueous solution of di(2-ethyl)hexyl sulfosuccinate, 1.5 g of a 2% by weight aqueous solution of a compound expressed by the following formula (27):

$C_8F_{17}SO_2N(C_3H_7)CH_2COOK$ Chemical formula (27)

and 17 g of a 20% colloidal silica (trade name: SNOWTEX O; manufactured by Nissan Chemical Industries, Ltd.) were mixed to prepare a coating solution I for a back coat layer.

<Preparation of a transparent substrate>

On one surface of a polyethylene terephthalate (PET) film having a thickness of 175 μm which had a blue color of x=0.2850 and y=0.2995 in accordance with the chromatic coordinates specified in Japanese Industrial Standard Z8701, SBR latex was applied so that a layer of 0.3 g/m$^2$ was formed after being dried. On the thus prepared layer, a solution prepared by mixing 200 g of a 5% by weight aqueous solution of gelatin (NITTA gelatin #810), 0.5 g of a 5% by weight dispersion of polymethyl methacrylate resin particles having a diameter of 2 μm in gelatin (content of polymethyl methacrylate resin: 10% by weight), 1.0 g of a 3% by weight aqueous solution of 1,2-benzothiazoline-3-one and 10 g of a 2% by weight aqueous solution of di(2-ethyl)hexyl sulfosuccinate was coated so that a layer of 0.1 g/m$^2$ was formed after being dried.

The other surface of the PET film was also coated in the same manner as that described above and the primer layer was formed on both surfaces of the substrate.

<Preparation of a heat-sensitive recording material>

On one surface of the substrate having the primer layers formed on both surfaces, the coating solution H for an ultraviolet light absorbing filter layer prepared above was applied in an amount forming a dried layer of 1.8 g/m$^2$ and dried.

On the thus formed ultraviolet light absorbing filter layer, the coating solution I for a back coat layer was applied in an amount forming a dried layer of 2.2 g/m$^2$ and dried. Thus, two layers were formed on the back surfaces of the substrate.

A coating solution was prepared by mixing 4.2 g of the coating solution of microcapsule A (concentration of solid components: 27%) prepared above, 10 g of the coating solution of microcapsule B (concentration of solid components: 27%) prepared above, 40 g of the emulsion for a developer C (concentration of the solid components: 21% by weight) prepared above and 0.4 g of a 50% by weight aqueous solution of a compound expressed by the following formula (28):

Chemical formula (28)

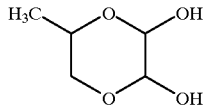

The resulting coating solution was applied to the surface of the substrate at the other side of the surface coated with the ultraviolet light absorbing filter layer and the back coat layer in an amount forming a dried layer of 13.5 g/m$^2$ and dried. Thus, a heat-sensitive recording layer was formed.

On the formed heat-sensitive recording layer, the coating solution F for a protective layer was applied in an amount forming a dried layer of 2.5 g/m$^2$ and dried. Thus, a protective layer was formed and the transparent heat-sensitive recording material of the present invention was prepared.

Evaluation of the Surface Roughness Ra

The roughness of the surface of the protective layer of the heat-sensitive recording material obtained above was measured by SURFTEST 501 (manufactured by Mitsutoyo Co., Ltd.). The data obtained by the measurement were filtered by means of a frequency cut filter to obtain a central line value Ra of the surface roughness in a frequency component having a frequency pitch of 2 to 10 μm in the surface roughness of the entire frequency region. The central line value Ra thus obtained was used as the index showing the surface roughness of the protective layer of the heat-sensitive recording material. The obtained results are shown in Table 1.

Measurement of Wear of a Thermal Head

A solid uniform recording on the heat-sensitive recording material obtained above was carried out for 1000 m in length by using a thermal head KGT-260-HPH8 (manufactured by Kyocera Corp.) in which the pulse width was adjusted so as to give a thermal energy of 110 mJ/mm$^2$ under an applied voltage of 15.5 V. A platen rubber roller having a JIS hardness of 50 (measured in accordance with Japanese Industrial Standard K6301 using a spring-type hardness meter A) was used at a head pressure of 7 kg/cm (a width of B4 size). The shape of the head was measured before and after the recording using a non-contact surface roughness meter (P-1 LONG SCAN PROFILER, manufactured by Tencor Company) and the wear (μm) was obtained. The obtained results are shown also in Table 1 together with the Ra values.

Example 2

A transparent heat-sensitive recording material was prepared in accordance with the same procedures as those followed in Example 1 except that a dispersion of a pigment for a protective layer E$^2$ having an average particle diameter of 0.260 μm and a content of particles having a diameter of 1.0 μm or more of 1.5% was used in place of the dispersion E of the pigment for the protective layer used in Example 1.

The surface roughness Ra and the wear of a thermal head were measured in accordance with the same methods as those used in Example 1. The obtained results are shown in Table 1.

Example 3

A transparent heat-sensitive recording material was prepared in accordance with the same procedures as those followed in Example 1 except that a dispersion of a pigment for a protective layer E$^3$ having an average particle diameter of 0.235 μm and a content of particles having a diameter of 1.0 μm or more of 0.3% was used in place of the dispersion E of the pigment for the protective layer used in Example 1.

The surface roughness Ra and the wear of a thermal head were measured in accordance with the same methods as those used in Example 1. The obtained results are shown in Table 1.

Example 4

A transparent heat-sensitive recording material was prepared in accordance with the same procedures as those followed in Example 1 except that kaolin was used in place of aluminum hydroxide used in the dispersion E of the pigment for the protective layer and a dispersion of a pigment for a protective layer E$^4$ having an average particle diameter of 0.290 μm and a content of particles having a diameter of 1.0 μm or more of 2.8% was used in place of the dispersion of the pigment for the protective layer E used in Example 1.

The surface roughness Ra and the wear of a thermal head were measured in accordance with the same methods as those used in Example 1. The obtained results are shown in Table 1.

Example 5

To 5 g of a diazo compound expressed by the following formula (29):

Chemical formula (29)

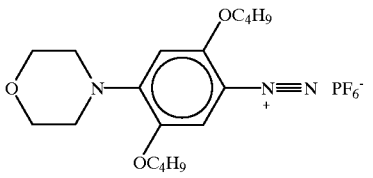

15 g of methylene chloride, 5 g of tricresyl phosphate, 15 g of trimethylolpropane trimethacrylate and 20 g of a 75% by weight solution of an adduct of m-xylylene diisocyanate with trimethylolpropane in a ratio of 3:1 in ethyl acetate (trade name: TAKENATE D110N; manufactured by Takeda Chemical Industries, Ltd.) were added and mixed uniformly to prepare a solution of the oil phase L.

The prepared solution of the oil phase L was mixed with 60 g of a 7% by weight aqueous solution of polyvinyl alcohol (trade name: PVA 217E; manufactured by Kuraray Co., Ltd.) and the mixture was emulsified using an ACE HOMOGENIZER (manufactured by Nippon Seiki Co., Ltd.) at a rotation speed of 8,000 rpm for 5 minutes.

To the thus obtained emulsion, 50 g of water was added and the resulting emulsion was subjected to the reaction for formation of capsules at 40° C. for 3 hours to obtain a solution of microcapsules having an average particle diameter of 1.5 $\mu$m. After the reaction was completed, 10 ml of an ion exchange resin (trade name: MB-3; manufactured by Organo Corp.) was added to the solution of microcapsules. After the mixture was stirred for 30 minutes, the mixture was filtered to obtain a solution of microcapsules M.

To 25 g of ethyl acetate, 4.3 g of a coupler expressed by the following formula (30):

Chemical formula (30)

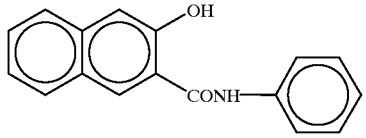

0.7 g of a coupler expressed by the following formula (31):

Chemical formula (31)

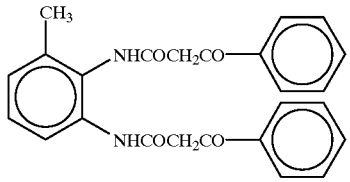

5 g of 1,2,3-triphenylguanidine, 0.8 g of tricresyl phosphate and 0.2 g of diethyl maleate were dissolved. The obtained solution was added to an aqueous phase prepared by mixing 15 g of water, 40 g of a 8% by weight aqueous solution of polyvinyl alcohol and 0.5 g of sodium dodecylbenzenesulfonate and the obtained mixture was emulsified by an ACE HOMOGENIZER (manufactured by Nippon Seiki Co., Ltd.) at a rotation speed of 10,000 rpm so that the average particle diameter became 0.5 $\mu$m and an emulsion of couplers N was obtained.

<Preparation of a heat-sensitive recording material>

The solution of microcapsules M containing the diazo compound prepared above (content of solid components: 25% by weight) in an amount of 5.0 g and 15 g of the emulsion of couplers N (content of solid components: 16% by weight) prepared above were mixed together while being stirred. The obtained mixture solution was applied to the same substrate as that used in Example 1 in an amount forming a dried layer of 15 g/m$^2$ and dried to form a heat-sensitive recording layer.

On the heat-sensitive recording layer formed above, the coating solution for a protective layer F prepared in Example 1 was applied in an amount forming a dried layer of 2.5 g/m$^2$ and dried. Thus, a transparent heat-sensitive recording material was prepared.

The surface roughness Ra and the wear of a thermal head were measured in accordance with the same methods as those used in Example 1. The obtained results are shown in Table 1.

Example 6

<Preparation of a dispersion of silver behenate>

Distilled water in an amount of 3 liters, 120 g (0.35 mol) of silver behenate, 14.1 g of a 0.12% by mol aqueous solution of sodium hydroxide, 1 ml of a 0.56% by mol dilute nitric acid and 59.25 g of a 0.23% by mol aqueous solution of silver nitrate were used. Into a 5 liter round bottom flask equipped with a Hirechberg stirrer and a heating mantle, 3 liters of distilled water was placed and heated at a temperature of about 80° C. To the heated water, 120 g (0.35 mol) of silver behenate was added and the mixture was vigorously stirred until a fine dispersion was formed (for about 20 minutes). To this dispersion, 14.1 g of the aqueous solution of sodium hydroxide was rapidly added dropwisely using a funnel.

The reaction mixture was stirred for further 30 minutes until a milky colloid was formed. Then, 1 ml of the dilute nitric acid was added to ensure that no free hydroxide remained. After the heating was stopped and the temperature decreased to about 50° C., 59.25 g of silver nitrate was added dropwise to the dispersion over 30 minutes while the dispersion was vigorously stirred. The stirring was continued until the viscosity of the dispersion decreased markedly and then for a further 20 minutes to ensure that the entire amount of the reacting components had been consumed.

An excess amount of silver behenate was recovered from the above dispersion by filtration using a Buichner funnel. The recovered silver behenate was formed into a slurry using 2 liters of water and then filtered. The remaining solid was washed thoroughly with distilled water until silver chloride was not formed by the addition of sodium chloride into the filtrate and dried at 50° C. for several days to a constant weight.

Methyl ethyl ketone in an amount of 220 g, 60 g of toluene, 10 g of polyvinyl butyral (trade name: BUTVAR B-76; manufactured by MONSANTO Company) dissolved in 50 g of methyl isobutyl ketone and 100 g of dry silver behenate obtained above were dispersed for 48 hours in a ball mill and a dispersion P of silver behenate in polyvinyl butyral which contained 5.5% by weight of silver in the form of silver behenate was obtained.

<Preparation of a coating solution Q for a heat-sensitive recording layer>

To 100 g of the dispersion P of silver behenate in polyvinyl butyral, 325 g of ethyl alcohol was added and uniformly mixed. To the obtained mixture, 2 ml of a solution prepared by dissolving 0.1 mol of silver bromide in 20 ml of methyl alcohol and 46 g of a 10% by weight acetone solution of polyvinyl butyral were successively added to obtain a dispersion. To 20 g of the obtained dispersion, 0.3 g of 2-(4-hydroxy-3,5-dimethoxy)-4,5-bis(p-methoxyphenyl) imidazole, 0.2 g of phthaladinone and 0.1 g of 1,2,3-benzotriazine-4(3H)-one were added and a coating solution Q for a heat-sensitive recording layer was obtained.

The coating solution Q for a heat-sensitive recording layer obtained above was applied to the same substrate as that used in Example 1 in an amount forming a dried layer of 20 g/m$^2$ and dried to form a heat-sensitive recording layer.

To the heat-sensitive recording layer formed above, the coating solution F for protective layer prepared in Example 1 was applied in an amount forming a dried layer of 2.5 g/m$^2$ and dried to form a transparent heat-sensitive recording material.

The surface roughness Ra and the wear of a thermal head were measured in accordance with the same methods as those used in Example 1. The obtained results are shown in Table 1.

Comparative Example 1

A transparent heat-sensitive recording material having a surface roughness Ra of 0.330 μm was prepared in accordance with the same procedures as those followed in Example 1 except that 2 g of 10% by weight aqueous solution of sodium dodecylbenzenesulfonate was not used in the preparation of the coating solution F for a protective layer described in Example 1.

The wear of a thermal head was measured in accordance with the same method as that used in Example 1. The obtained results are shown in Table 1.

Comparative Example 2

A transparent heat-sensitive recording material was prepared in accordance with the same procedures as those followed in Example 1 except that a coating solution E$^5$ for a protective layer having an average particle diameter of 0.400 μm and a content of particles having a diameter of 1.0 μm or more of 4.7% was used in place of the coating solution E for a protective layer used in Example 1.

The surface roughness Ra and the wear of a thermal head were measured in accordance with the same methods as those used in Example 1. The obtained results are shown in Table 1.

Comparative Example 3

A transparent heat-sensitive recording material was prepared in accordance with the same procedures as those conducted in Example 1 except that a coating solution E$^6$ for a protective layer which was prepared by mixing the coating solution E for a protective layer used in Example 1 and the coating solution E$^5$ for a protective layer used in Comparative Example 2 and had an average particle diameter of 0.285 μm and a content of particles having a diameter of 1.0 μm or more of 3.1% was used in place of the coating solution E for a protective layer used in Example 1.

The surface roughness Ra and the wear of a thermal head were measured in accordance with the same methods as those used in Example 1. The obtained results are shown in Table 1.

TABLE 1

| | | pigment in protective layer | | | | |
|---|---|---|---|---|---|---|
| | composition of heat sensitive recording layer | type | average particle diameter in portion of 50% by volume (μm) | content of particles having diameter of 1.0 μm or more (%) | surface roughness of protective layer Ra (μm) | wear of thermal head (μm) |
| Example 1 | leuko dye capsule + emulsion of developer | aluminum hydroxide | 0.275 | 2.0 | 0.265 | 0.50 |
| Example 2 | leuko dye capsule + emulsion of developer | aluminum hydroxide | 0.260 | 1.5 | 0.260 | 0.35 |
| Example 3 | leuko dye capsule + emulsion developer | aluminum hydroxide | 0.235 | 0.3 | 0.240 | 0.20 |
| Example 4 | leuko dye capsule + emulsion of developer | kaolin | 0.290 | 2.8 | 0.290 | 0.60 |
| Example 5 | diazo capsule + emulsion of coupler | aluminum hydroxide | 0.275 | 2.0 | 0.280 | 0.55 |
| Example 6 | dispersion of silver behenate + emulsion of reducing agent | aluminum hydroxide | 0.275 | 2.0 | 0.270 | 0.40 |
| Comparative Example 1 | leuko dye capsule + emulsion of developer | aluminum hydroxide | 0.275 | 2.0 | 0.330 | 1.4 |

TABLE 1-continued

| | composition of heat sensitive recording layer | pigment in protective layer | | | | |
|---|---|---|---|---|---|---|
| | | type | average particle diameter in portion of 50% by volume (μm) | content of particles having diameter of 1.0 μm or more (%) | surface roughness of protective layer Ra (μm) | wear of thermal head (μm) |
| Comparative Example 2 | leuko dye capsule + emulsion of developer | aluminum hydroxide | 0.400 | 4.7 | 0.335 | 1.9 |
| Comparative Example 3 | leuko dye capsule + emulsion of developer | aluminum hydroxide | 0.285 | 3.1 | 0.315 | 1.2 |

As shown in the results of Examples 1 to 6 in Table 1, the heat-sensitive recording materials of the present invention, which contained the pigment specified by the present invention in the protective layer and had the surface roughness of the protective layer in the range specified by the present invention, exhibited a remarkably reduced wear of the thermal head even when the recording was carried out with a high thermal energy. The heat-sensitive recording materials exhibited excellent performance during recording without sticking or generation of noise and images having no uneven density or missing portions were formed.

In contrast, it is clearly shown that the heat-sensitive recording materials of Comparative Examples 1 to 3, which contained pigments not specified by the present invention in the protective layer or had a surface roughness outside the range specified by the present invention, showed increased wear of the thermal head when the recording was carried out with a high thermal energy.

As described above, even when the recording was carried out by the application of a high thermal energy, the heat-sensitive recording material of the present invention could provide sharp images without the formation of blurred images or defects in images such as missing portions which are caused by wear of a thermal head. Therefore, it is shown that the heat-sensitive recording material of the present invention is a recording medium suitable for use as a recording material in the medical field in which stable formation of high quality images is required without formation of images having uneven densities or missing portions.

To summarize the advantages of the present invention, the heat-sensitive recording material does not cause sticking or generation of noise during recording, has an excellent transparency, reduces wear of a thermal head even in recording using a high thermal energy and provides high quality images with stability for a long time.

The heat-sensitive recording material of the present invention is advantageously used as a recording material in the medical field in which stable formation of high quality images are required.

What is claimed is:

1. A heat-sensitive recording material comprising a substrate, a heat-sensitive recording layer disposed on the substrate and a protective layer disposed on the heat-sensitive recording layer, wherein the protective layer comprises a pigment which contains particles having a volume average particle diameter of 0.300 μm or less in a portion of 50% by volume of the total volume of the particles as measured by a laser diffraction method and which contains 3% or less of particles having a diameter of 1.0 μm or more in a total amount of particles and the surface of the protective layer has a central line value Ra of a surface roughness of 0.3 μm or less in a frequency component having a roughness pitch of 2 to 10 μm of the surface roughness in of the surface roughness in the entire frequency range.

2. A heat-sensitive recording material according to claim 1, wherein the volume average particle diameter is in a range of 0.200 to 0.300 μm in a portion of 50% by volume.

3. A heat-sensitive recording material according to claim 2, wherein the pigment is an inorganic pigment selected from the group consisting of calcium carbonate, titanium oxide, kaolin, aluminum hydroxide, amorphous silica and zinc oxide.

4. A heat-sensitive recording material according to claim 2, wherein the pigment is an organic pigment selected from the group consisting of urea-formaldehyde resins and epoxy resins.

5. A heat-sensitive recording material according to claim 1, wherein an energy required to obtain a transmission density $D_T$ of 3.0 is 90 to 150 mJ/mm$^2$ in a color developed portion.

6. A heat-sensitive recording material according to claim 5, wherein the pigment is an inorganic pigment selected from the group consisting of calcium carbonate, titanium oxide, kaolin, aluminum hydroxide, amorphous silica and zinc oxide.

7. A heat-sensitive recording material according to claim 5, wherein the pigment is an organic pigment selected from the group consisting of urea-formaldehyde resins and epoxy resins.

8. A heat-sensitive recording material according to claim 1, wherein the pigment is an inorganic pigment selected from the group consisting of calcium carbonate, titanium oxide, kaolin, aluminum hydroxide, amorphous silica and zinc oxide.

9. A heat-sensitive recording material according to claim 8, wherein the heat-sensitive recording layer comprises at least one electron-donating dye precursor selected from the group consisting of triphenylmethane phthalide compounds, fluoran compounds, phenothiazine compounds, indolyl phthalide compounds, leuko auramine compounds, rhodamine lactum compounds, triphenylmethane compounds, triazene compounds, spiropyran compounds and fluorene compounds and at least one electron-accepting compound selected from the group consisting of phenol compounds, organic acids, salts of organic acids and esters of oxybenzoic acid.

10. A heat-sensitive recording material according to claim 8, wherein the heat-sensitive recording layer comprises a photodecomposable diazo compound selected from the group consisting of aromatic diazonium compounds, diazosulfonate compounds and diazoamino compounds and a coupler, the aromatic diazonium compound being represented by the following general formula:

$$Ar—N_2^+X^-$$

wherein Ar represents a substituted or unsubstituted aromatic hydrocarbon ring group, $N_2^+$ represents a diazonium group and $X^-$ represents an acid anion.

11. A heat-sensitive recording material according to claim 10, wherein the photodecomposable diazonium compound is present in each microcapsule.

12. A heat-sensitive recording material according to claim 1, wherein the pigment is an organic pigment selected from the group consisting of urea-formaldehyde resins and epoxy resins.

13. A heat-sensitive recording material according to claim 12, wherein the heat-sensitive recording layer comprises at least one electron-donating dye precursor selected from the group consisting of triphenylmethane phthalide compounds, fluoran compounds, phenothiazine compounds, indolyl phthalide compounds, leuko auramine compounds, rhodamine lactum compounds, triphenylmethane compounds, triazene compounds, spiropyran compounds and fluorene compounds and at least one electron-accepting compound selected from the group consisting of phenol compounds, organic acids, salts of organic acids and esters of oxybenzoic acid.

14. A heat-sensitive recording material according to claim 13, wherein the electron-donating dye precursor is present in each microcapsule.

15. A heat-sensitive recording material according to claim 12, wherein the heat-sensitive recording layer comprises a photodecomposable diazo compound selected from the group consisting of aromatic diazonium compounds, diazosulfonate compounds and diazoamino compounds and a coupler, the aromatic diazonium compound being represented by the following general formula:

$$Ar—N_2^+X^-$$

wherein Ar represents a substituted or unsubstituted aromatic hydrocarbon ring group, $N_2^+$ represents a diazonium group and $X^-$ represents an acid anion.

16. A heat-sensitive recording material according to claim 15, wherein the photodecomposable diazonium compound is present in each microcapsule.

17. A heat-sensitive recording material according to claim 1, wherein the heat-sensitive recording layer comprises at least one electron-donating dye precursor selected from the group consisting of triphenylmethane phthalide compounds, fluoran compounds, phenothiazine compounds, indolyl phthalide compounds, leuko auramine compounds, rhodamine lactum compounds, triphenylmethane compounds, triazene compounds, spiropyran compounds and fluorene compounds and at least one electron-accepting compound selected from the group consisting of phenol compounds, organic acids, salts of organic acids and esters of oxybenzoic acid.

18. A heat-sensitive recording material according to claim 17, wherein the electron-donating dye precursor is present in each microcapsule.

19. A heat-sensitive recording material according to claim 1, wherein the heat-sensitive recording layer comprises a photodecomposable diazo compound selected from the group consisting of aromatic diazonium compounds, diazosulfonate compounds and diazoamino compounds and a coupler, the aromatic diazonium compound being represented by the following general formula:

$$Ar—N_2^+X^-$$

wherein Ar represents a substituted or unsubstituted aromatic hydrocarbon ring group, $N_2^+$ represents a diazonium group and $X^-$ represents an acid anion.

20. A heat-sensitive recording material according to claim 19, wherein the photodecomposable diazonium compound is present in each microcapsule.

* * * * *